US011395390B2

(12) United States Patent
Sondericker, III et al.

(10) Patent No.: US 11,395,390 B2
(45) Date of Patent: Jul. 19, 2022

(54) LED LIGHTING ASSEMBLY WITH INTEGRATED POWER CONVERSION AND DIGITAL TRANSCEIVER

(71) Applicant: Dialight Corporation, Farmingdale, NJ (US)

(72) Inventors: John Herbert Sondericker, III, Colorado Springs, CO (US); Rizwan Ahmad, Edison, NJ (US)

(73) Assignee: DIALIGHT CORPORATION, Farmingdale, NJ (US)

( * ) Notice: Subject to any disclaimer, the term of this patent is extended or adjusted under 35 U.S.C. 154(b) by 23 days.

(21) Appl. No.: 16/795,754

(22) Filed: Feb. 20, 2020

(65) Prior Publication Data

US 2020/0275541 A1 Aug. 27, 2020

Related U.S. Application Data

(60) Provisional application No. 62/808,383, filed on Feb. 21, 2019.

(51) Int. Cl.
*H05B 47/19* (2020.01)
*H05B 45/37* (2020.01)

(52) U.S. Cl.
CPC ..... *H05B 45/37* (2020.01); *H05B 47/19* (2020.01)

(58) Field of Classification Search
CPC ..... H05B 47/175; H05B 47/19; H05B 45/30; H05B 45/37; H05B 45/39; H05B 45/54; H05B 47/17; F21V 23/004; F21V 23/005; F21V 23/0435
See application file for complete search history.

(56) References Cited

U.S. PATENT DOCUMENTS 5,404,282 A * 4/1995 Klinke ..... F21S 43/14 362/249.14
6,411,045 B1 * 6/2002 Nerone ..... H05B 45/37 315/291
8,513,896 B2 * 8/2013 Grebner ..... H05B 45/38 315/307
8,686,655 B2 * 4/2014 Setomoto ..... H05B 45/39 315/200 R
8,742,694 B2 6/2014 Bora et al.
8,933,473 B1 * 1/2015 Dubin ..... H01L 21/67173 257/98
9,052,069 B2 * 6/2015 Romas ..... F21V 23/005
(Continued)

OTHER PUBLICATIONS

Why is the monolithic capacitor?, YTF Capacitor & Resistor Brand Supplier, Sep. 2, 2019, printed from https://www.vtfcapacitor.com/news/Monolithic-capacitor.html, 10 pages.
(Continued)

*Primary Examiner* — Tung X Le
(74) *Attorney, Agent, or Firm* — Tong, Rea, Bentley & Kim, LLC

(57) ABSTRACT

The present disclosure is directed to examples of a light emitting diode (LED) assembly. In one embodiment, the LED assembly includes a substrate, at least one LED coupled to the substrate, a power converter module formed on the substrate, wherein the power converter module is to power the at least one LED, a monolithic capacitor formed in the substrate and coupled to the power converter module, and a digital transceiver coupled to the substrate.

12 Claims, 4 Drawing Sheets

(56) References Cited

U.S. PATENT DOCUMENTS

| | | | | |
|---|---|---|---|---|
| 10,143,053 | B1 | 11/2018 | Wilson et al. | |
| 2003/0122502 | A1* | 7/2003 | Clauberg | H05B 45/39 315/291 |
| 2006/0256003 | A1* | 11/2006 | Mor | G01S 19/36 342/357.55 |
| 2010/0156308 | A1* | 6/2010 | Maehara | H05B 45/44 315/224 |
| 2012/0169231 | A1 | 7/2012 | Dine et al. | |
| 2013/0236183 | A1* | 9/2013 | Chao | H04B 10/116 398/101 |
| 2014/0184070 | A1* | 7/2014 | Lu | H05B 45/345 315/85 |
| 2014/0209931 | A1 | 7/2014 | Liao | |
| 2014/0233226 | A1 | 8/2014 | Wallace et al. | |
| 2015/0206861 | A1* | 7/2015 | Dubin | H01L 25/167 438/26 |
| 2015/0236221 | A1* | 8/2015 | Deak, Sr. | C08G 18/4238 315/185 R |
| 2016/0029444 | A1* | 1/2016 | Kamoi | H05B 45/48 315/193 |
| 2016/0050731 | A1 | 2/2016 | Jung | |
| 2016/0128158 | A1 | 5/2016 | Harder | |
| 2016/0227636 | A1 | 8/2016 | Sun et al. | |
| 2016/0234899 | A1* | 8/2016 | Reed | H05B 45/46 |
| 2016/0302280 | A1* | 10/2016 | Harbers | F21V 23/006 |
| 2018/0288839 | A1 | 10/2018 | Safaee | |
| 2018/0374834 | A1* | 12/2018 | Tada | H01L 33/405 |
| 2019/0335570 | A1* | 10/2019 | Chen | H05B 45/46 |
| 2020/0146119 | A1* | 5/2020 | Li | H01L 25/0753 |

OTHER PUBLICATIONS

International Search Report and Written Opinion mailed in corresponding PCT/US2020/019035 dated May 6, 2020, 24 pages.

* cited by examiner

200

500

600

700

800

LED LIGHTING ASSEMBLY WITH INTEGRATED POWER CONVERSION AND DIGITAL TRANSCEIVER

CROSS REFERENCE TO RELATED APPLICATIONS

This application claims priority under 35 U.S.C. § 119(e) to U.S. provisional patent application Ser. No. 62/808,383, filed on Feb. 21, 20190, which is hereby incorporated by reference in its entirety.

BACKGROUND

Locations use lights to provide illumination. Over the years, light sources of light fixtures that provide illumination have evolved from filament based Edison bulbs to more power efficient light emitting diodes (LEDs). LED light fixtures generally are designed with external power sources that provide power to the LEDs.

In addition, industry today relies on the transmission of data. Data is continuously transmitted for monitoring, automation control, and the like. Typically, data can be transmitted over wired and wireless networks that are deployed for transmitting data. For example, fiber optics networks and wireless networks with routers and gateways may be deployed to build a communication network. The cost to deploy these networks can be very expensive.

SUMMARY

In one embodiment, the present disclosure provides a light emitting diode (LED) assembly. In one embodiment, the LED assembly comprises a substrate, at least one LED coupled to the substrate, and a power converter module formed on the substrate, wherein the power converter module is to power the at least one LED.

In one embodiment, the present disclosure provides another embodiment of an LED assembly. In one embodiment, the LED assembly comprises a substrate, at least one LED coupled to the substrate, a power converter module formed on the substrate, wherein the power converter module is to power the at least one LED, and a digital transceiver coupled to the substrate.

In one embodiment, the present disclosure provides another embodiment of an LED assembly. In one embodiment, the LED assembly comprises a substrate, at least one LED coupled to the substrate, a power converter module formed on the substrate, wherein the power converter module is to power the at least one LED, a monolithic capacitor formed in the substrate and coupled to the power, and a digital transceiver coupled to the substrate.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present disclosure provides an LED lighting assembly with integrated power conversion and digital transceiver. As noted above, light fixtures are used to provide illumination in various locations. Current LED based light fixtures are fabricated with external power supplies. This can lead to a bulkier and heaver LED light fixture design.

In addition, industry today relies on the transmission of data. Data is continuously transmitted for monitoring, automation control, and the like. Typically, data can be transmitted over wired and wireless networks that are deployed for transmitting data. For example, fiber optics networks and wireless networks with routers and gateways may be deployed to build a communication network. The cost to deploy these networks can be very expensive.

However, all facilities use lights to illuminate the facilities. Thus, using the lights inside of a facility to transport data may reduce the overall costs for implementing a separate communication network to transmit the data. Connected lighting systems may offer the promise of functioning as a portal for the collection and transport of a vast array of data, as well as signaling actuators for control applications.

Lighting systems have for many years offered a 0-10 Volt (V) analog control input for dimming the output of a fixture. The digitally encoded messages for affecting control and performing remote monitoring operations have become popular with the use of microprocessors.

Examples of the present disclosure provide an LED lighting assembly with integrated power conversion and a digital transceiver that provides a more compact and efficient design that can provide illumination and transmit or receive data. The present disclosure incorporates the LED light, a power converter module, and a digital transceiver onto a single or common substrate. The LED light may provide general illumination. The power converter module may receive alternating current (AC) input voltage and drive the LEDs on an output of the power converter module. The digital transceiver may provide bi-directional controls. The simplification of the product design onto a single substrate may offer advantages in cost and ease of assembly.

Figure 1:
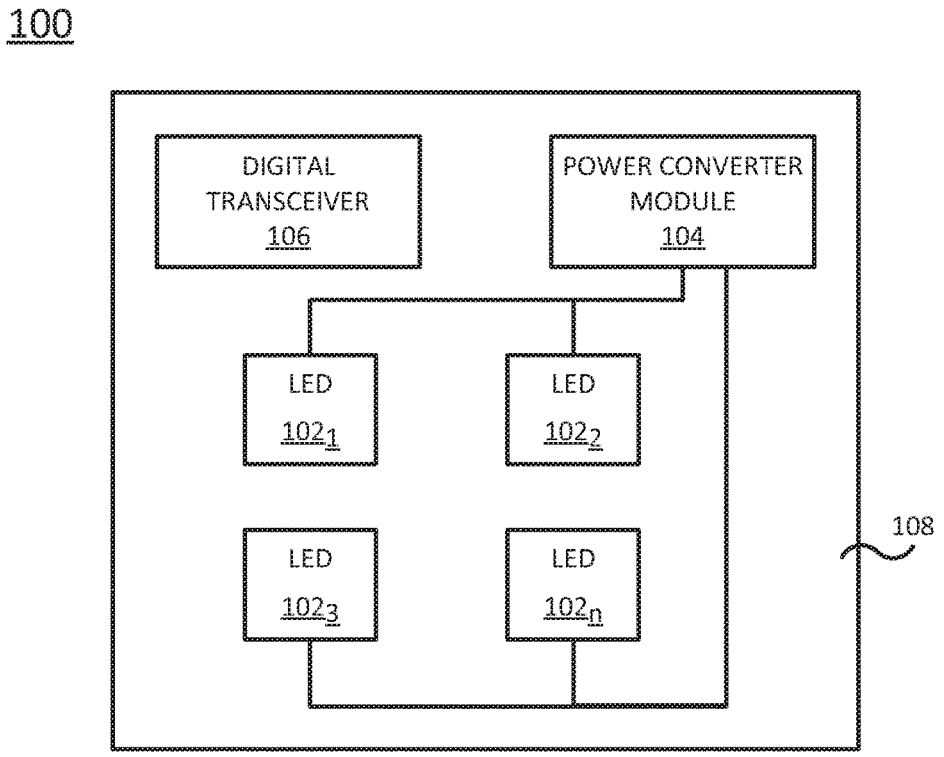
FIG. 1 depicts a block diagram of one embodiment of an LED lighting assembly of the present disclosure.
Figure 9:
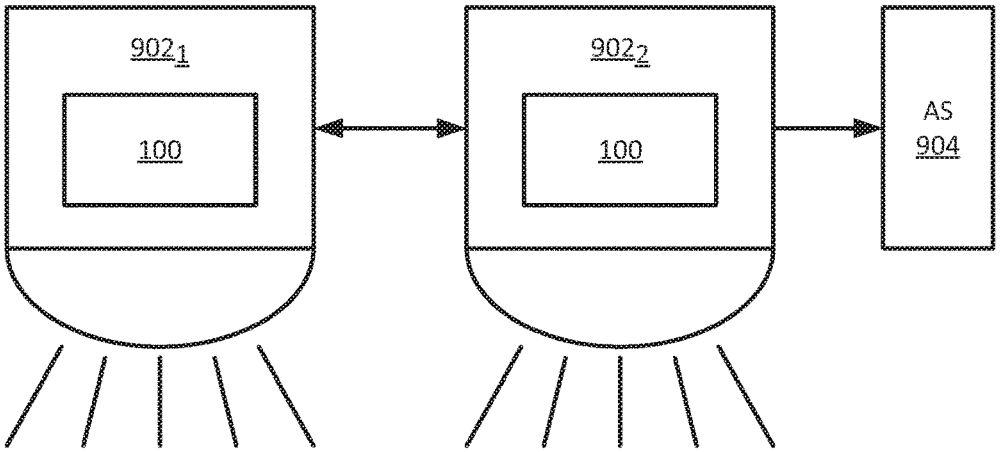
FIG. 9 depicts a block diagram of light fixtures that include the LED lighting assembly of the present disclosure.

FIG. 1 illustrates an example LED assembly 100 of the present disclosure. In one embodiment, the LED assembly 100 may be part of an LED light fixture. For example, the LED assembly 100 may be enclosed within a housing with a heat sink to dissipate heat. The light fixture may then be mounted in a location to provide illumination. An example is illustrated in FIG. 9 and discussed below.

In one embodiment, the LED assembly 100 may include a substrate 108. The substrate 108 may be a printed circuit board or a metal core board with no through holes that includes integrated circuitry. In other words, electrical lines may be fabricated into the substrate 108 that allow various components of the LED assembly 100 to communicate with each other. The metal core board may also provide thermal management.

In one embodiment, the LED assembly 100 may include at least one LED 1021 to 102*n* (hereinafter also referred to individually as an LED 102 or collectively as LEDs 102). Although the LEDs 102 are illustrated in a particular arrangement in FIG. 1, it should be noted that the LEDs 102 may be arranged in any particular manner. For example, the LEDs 102 may be arranged in arrays. For example, each array of LEDs 102 may be controlled independently.

In one embodiment, the LED assembly 100 may include a power converter module (PCM) 104 and a digital transceiver (DT) 106. In one embodiment, the PCM 104 and the DT 106 may be integrated on the same substrate 108 as the LEDs 102. In other words, the PCM 104 and the DT 106 are not separate components that are coupled to the LEDs via an external connection, cable, wire, and the like. Rather, the PCM 104 and the DT 106 may be integrated to communicate with the LEDs 102 via circuits that are formed in the substrate 108. Said another way, the PCM 104 and the DT 106 may be soldered to electrical pads on the substrate 108 that are in communication with the LEDs 102. In other embodiments, the PCM 104 and the DT 106 may be fabricated or integrated as part of the substrate 108. In other words, the PCM 104 and the DT 106 may be a part of the substrate 108 (e.g., cannot be physically removed from the substrate 108 like discrete power converter and digital transceiver components of prior designs/light assemblies).

In one embodiment, the PCM 104 may be a component that converts voltage received in a direct current (DC) waveform into a voltage that is in an alternating current (AC) waveform. For example, the LEDs 102 may operate with AC power. However, a power source may be a DC power source. The PCM 104 may convert the DC from the DC power source into an AC power source that is delivered to the LEDs 102. Notably, the PCM 104 may be deployed without large metal power components (e.g., large housings) such that the PCM 104 can be integrated into the substrate 108

In one embodiment, the DT 106 may be a component that can receive, transmit, and/or process data. For example, the data may be used by the LED assembly 100 or be data received from a remote controller to control functionality of the LEDs 102.

In one embodiment, the DT 106 may be a wired or wireless transceiver. For example, when the DT 106 is a wired transceiver, the DT 106 may be connected to another transceiver or communication module via a communications wire. In one embodiment, the communications wire may be an optical communications link or a fiber optic cable. The optical communications link may be realized via the user of visible light communications sent through the optical communications link (e.g., visible light communications (VLC) or Li-Fi).

Figure 6:
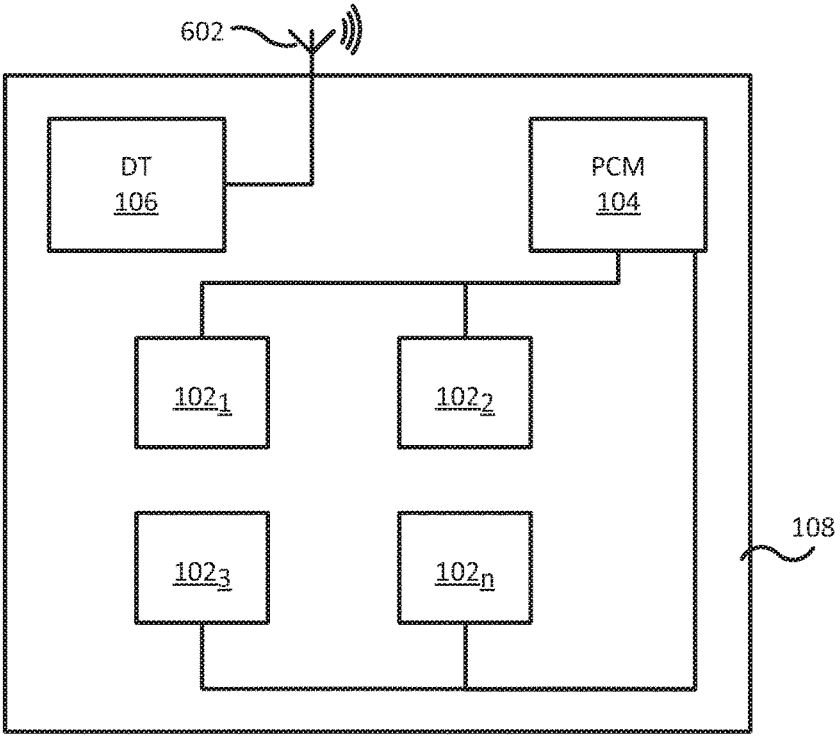
FIG. 6 depicts a block diagram of another embodiment of the LED lighting assembly of the present disclosure.
Figure 7:
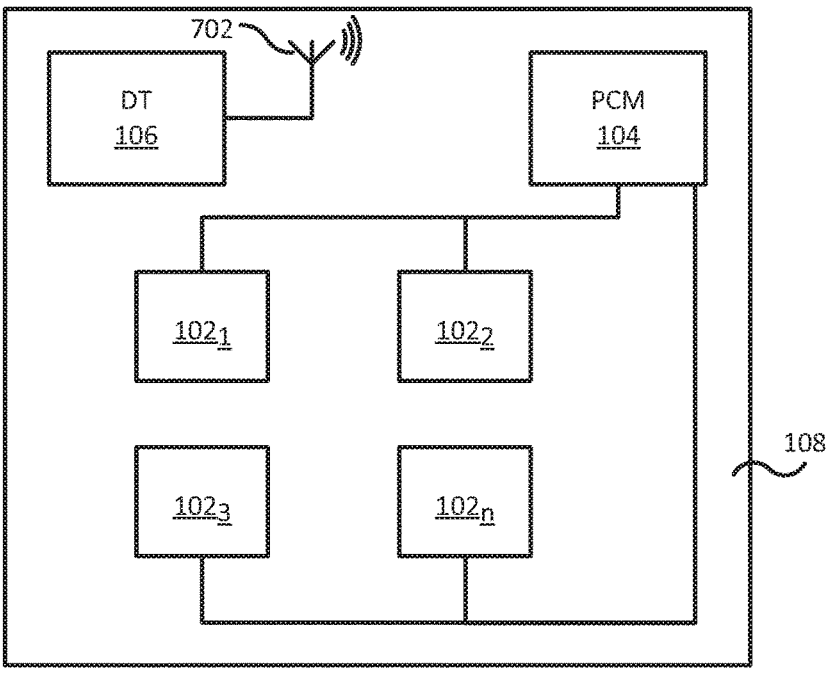
FIG. 7 depicts a block diagram of another embodiment of the LED lighting assembly of the present disclosure.
Figure 8:
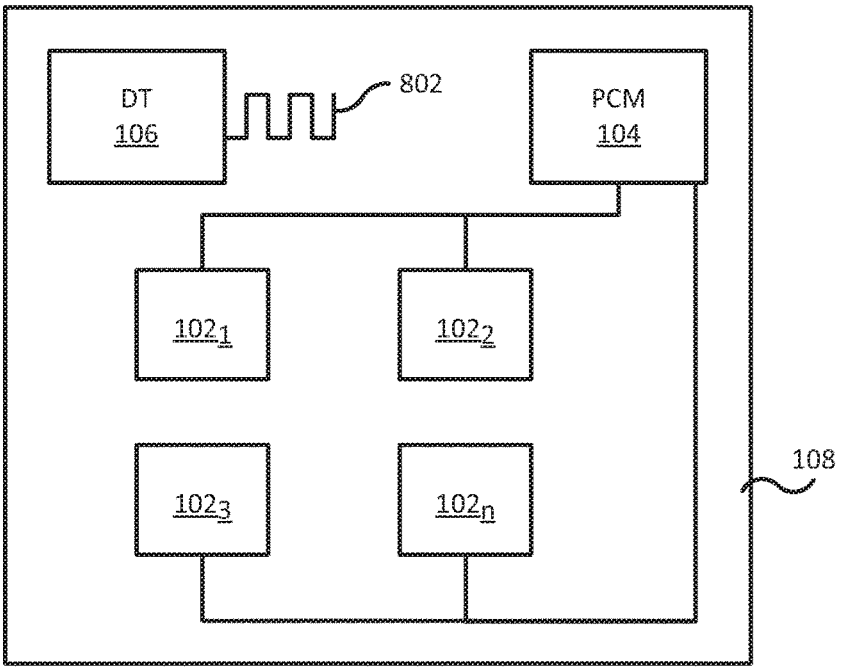
FIG. 8 depicts a block diagram of another embodiment of the LED lighting assembly of the present disclosure.

In one embodiment, when the DT 106 is a wireless transceiver, the DT 106 may communicate via an antenna using radio signals. Examples of various embodiments of the antenna are illustrated in FIGS. 6-8 and discussed in further details below.

It should be noted that the LED assembly 100 has been simplified for ease of explanation. For example, the LED assembly 100 may be electrically connected to other components that are not shown (e.g., a controller, a processor, and the like).

Since the LEDs 102, the PCM 104, and the DT 106 are integrated onto a single substrate 108, the LED assembly 100 may provide a smaller footprint, lower manufacturing costs, and easier installation/assembly. For example, as noted above, the PCM 104 may be integrated without the bulky metal housings of external power converters. Moreover, assembly may require only installing the LED assembly 100 into a housing rather than having to electrically connect the LEDs to an external power converter, as in previous designs.

Figure 2:
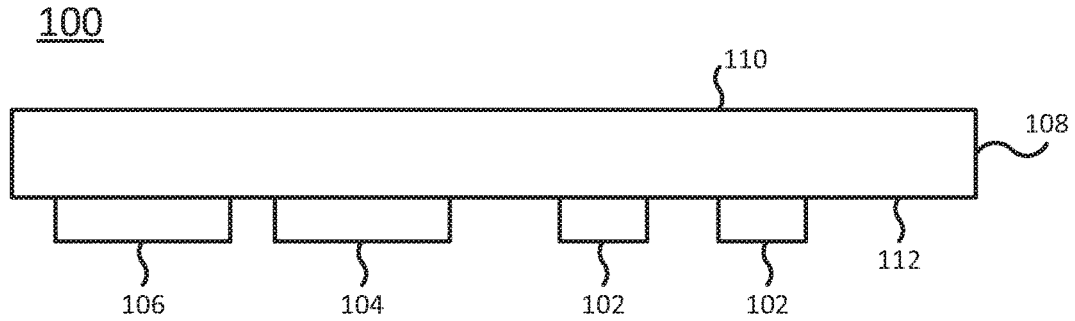
FIG. 2 depicts a cross-sectional block diagram of one embodiment of an example of the LED lighting assembly of the present disclosure.
Figure 3:
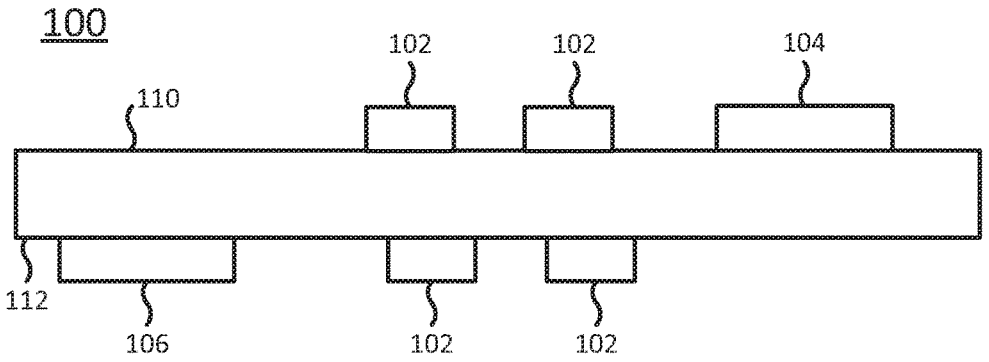
FIG. 3 depicts a cross-sectional block diagram of another embodiment of an example of the LED lighting assembly of the present disclosure.

FIGS. 2 and 3 illustrate cross-sectional block diagrams of the LED lighting assembly 100. FIG. 2 illustrates a block-diagram where the LEDs 102, the PCM 104, and the DT 106 are mounted on a same side of the substrate 108. For example, the substrate 108 may include a first side 110 and a second side 112. The first side 110 and the second side 112 may be opposite one another. The first side 110 and the second side 112 may refer to opposite sides of the substrate 108 with the greatest surface area.

FIG. 2 illustrates an example where the LEDs 102, the PCM 104, and the DT 106 are on the second side 112. However, it should be noted that the LEDs 102, the PCM 104, and the DT 106 may also be on the first side 110.

FIG. 3 illustrates an embodiment where the PCM 104 and the DT 106 may be mounted on opposite sides of the substrate 108. FIG. 3 illustrates an example where the PCM 104 may be mounted on the first side 110 and the DT 106 may be mounted on the second side 112. However, it should be noted that the PCM 104 may be mounted on the second side 112 and the DT 106 may be mounted on the first side 110.

In one embodiment, the LEDs 102 may be mounted all on the first side 110 or the second side 112. In another embodiment, as shown in FIG. 3, the LEDs 102 may be mounted on both sides of the substrate 108. For example, a first subset of the LEDs 102 may be mounted on the first side 110 of the substrate 108, and a second subset of the LEDs 102 may be mounted on the second side 112 of the substrate 108.

In the embodiment of FIG. 3, the substrate 108 may include integrated circuit lines that travel between each first side 110 and the second side 112 of the substrate 108. In other words, the substrate 108 may include electrical contacts on both the first side 110 and the second side 112 to electrically connect the LEDs 102 on both sides of the substrate 108 and/or electrically connect/integrate the PCM 104 and the DT 106 to either side 110 or 112 of the substrate 108.

Figure 4:
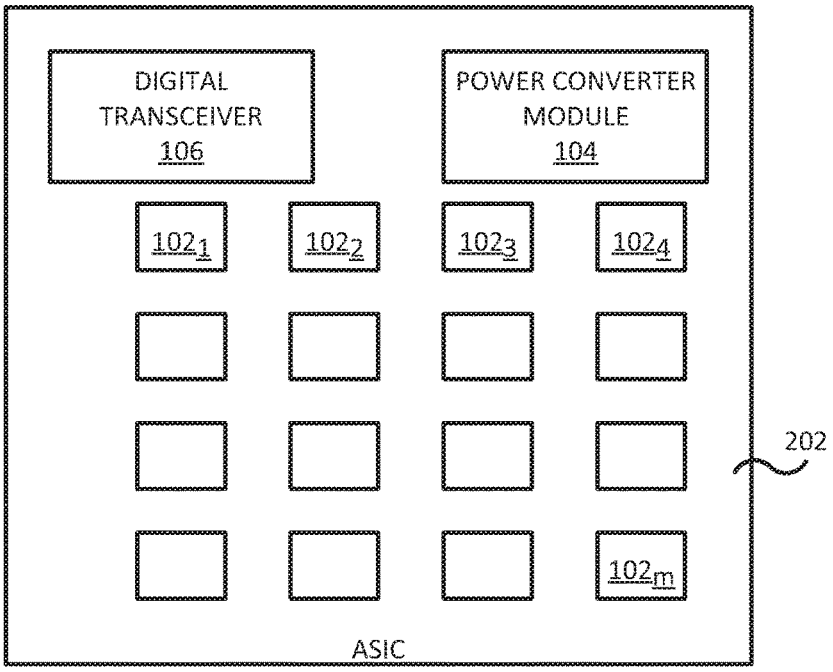
FIG. 4 depicts a block diagram of another embodiment of the LED lighting assembly of the present disclosure.

FIG. 4 illustrates an embodiment where the substrate may be an application specific integrated circuit (ASIC) substrate 202. For example, the LEDs 1021 to 102*m*, the PCM 104, and the DT 106 may be mounted on a monolithic ASIC substrate 202. In other words, the LEDs 102, the PCM 104, and the DT 106 may be integrated into a single integrated circuit (IC) package.

Figure 5:
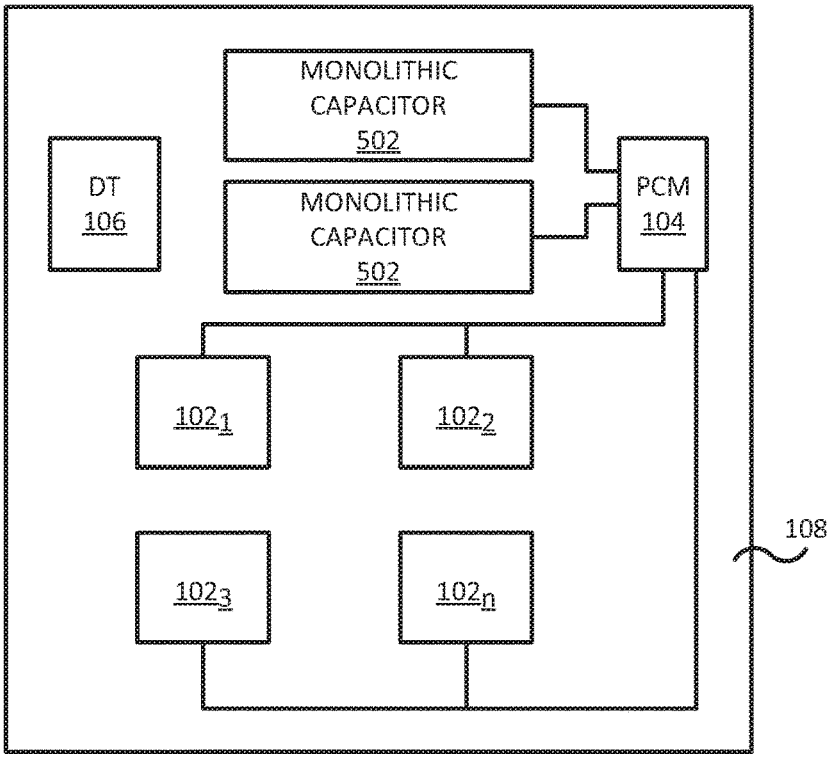
FIG. 5 depicts a block diagram of another embodiment of the I LED lighting assembly of the present disclosure.

FIG. 5 illustrates an embodiment of an LED assembly 500. The LED assembly 500 may include one or more monolithic capacitors 502. The monolithic capacitors 502 may be used to filter out DC power and deliver AC power to the LEDs 102. The monolithic capacitor 502 may also filter the AC input power to an output that is suitable for driving the LEDs 102.

In one embodiment, the monolithic capacitor 502 is formed in the substrate 108. For example, the monolithic capacitor 502 can be formed by manufacturing electrodes and a dielectric gap in the substrate 108 using semiconductor processing methods when the substrate 108 is manufactured.

FIGS. 6-8 illustrate various embodiments of an antenna that may be coupled to the DT 106 when the DT 106 is a wireless transceiver. FIG. 6 illustrates an example of an LED assembly 600. In one embodiment, the LED assembly 600 may include the LEDs 102, the PCM 104, and the DT 106. The DT 106 may be a wireless transceiver that is coupled to an external antenna 602. The external antenna 602 may be coupled to the DT 106 via a coaxial cable.

FIG. 7 illustrates an example of an LED assembly 700. In one embodiment, the LED assembly 700 may include the LEDs 102, the PCM 104, and the DT 106. The DT 106 may be a wireless transceiver that is coupled to an internal antenna 702. The internal antenna 702 may be mounted onto the substrate 108. For example, the internal antenna 702 may be mounted on a same side of the substrate 108 as the side on which the DT 106 is mounted. The internal antenna 702 may be directly wired to the DT 106.

FIG. 8 illustrates an example of an LED assembly 800. In one embodiment, the LED assembly 800 may include the LEDs 102, the PCM 104, and the DT 106. The DT 106 may be a wireless transceiver that is coupled to a substrate antenna 802. The substrate antenna 802 may be integrated into the substrate 108 and electrically connected to the DT 106. For example, metal traces may be fabricated into the substrate 108 to form the substrate antenna 802 using semiconductor/PCB manufacturing techniques used to manufacture the substrate 108.

It should be noted that portions of the various embodiments illustrated in FIGS. 1-8 can be combined. For example, the various antennas illustrated in FIGS. 6-8 can be combined with the ASIC substrate 202 illustrated in FIG. 4. In addition, the monolithic capacitors 502 illustrated in FIG. 5 may be added to any embodiment where the DT 106 is wired or wireless as illustrated in FIGS. 6-8. In other examples, the monolithic capacitors 502 may be mounted on a side of the substrate 108 with the PCM 104, with the DT 106, or on an opposite side of the DT 106, as illustrated in FIGS. 2 and 3.

FIG. 9 illustrates a block diagram of light fixtures 9021 and 9022 that each include the LED assembly 100 of the present disclosure. Although two light fixtures 9021 and 9022 are illustrated in FIG. 9, it should be noted that any number of light fixtures can be deployed.

In one embodiment, the light fixtures may include a housing that positions optics around the LED assembly 100. As a result, the light emitted from the LEDs 102 of the LED assembly 100 may be transmitted in a desired direction or pattern in a particular location.

In one embodiment, the light fixtures 9021 and 9022 may be networked together to communicate with one another. For example, data can be transmitted between the light fixtures 9021 and 9022 via the DT 106, as described above. In one embodiment, the light fixtures 9021 and 9022 may communicate with an application server (AS) 904. For example, the AS 904 may be a remotely located controller or server that can send control signals to the light fixtures 9021 and 9022. The control signals can be received by the DT 106 to control operation or functionality of the LEDs 102, as noted above.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light emitting diode (LED) assembly, comprising:

a substrate;

at least one LED arranged on the substrate, wherein the at least one LED operates on alternating current (AC) power;

a power converter module integrally formed on the substrate, wherein the power converter module is to convert a direct current (DC) of a voltage source to an AC to power the at least one LED;

a monolithic capacitor formed in the substrate via electrodes and a dielectric gap in the substrate and arranged on the power converter module to filter out DC power and deliver the AC power to the at least one LED; and a digital transceiver coupled to the substrate.

2. The LED assembly of claim 1, wherein the at least one LED, the power converter module, the monolithic capacitor, and the digital transceiver are arranged on a same side of the substrate.

3. The LED assembly of claim 1, wherein the digital transceiver comprises a wired transceiver.

4. The LED assembly of claim 3, wherein the wired transceiver is coupled to an optical link.

5. The LED assembly of claim 1, wherein the digital transceiver is coupled to an opposite side of the substrate from the power converter module.

6. The LED assembly of claim 1, wherein the at least one LED comprises a plurality of LEDs, wherein a first subset of the plurality of LEDs is arranged on a first side of the substrate and a second subset of the plurality of LEDs is arranged on a second side of the substrate that is opposite the first side of the substrate.

7. The LED assembly of claim 6, wherein the power converter module and the digital transceiver are arranged on opposite sides of the substrate.

8. The LED assembly of claim 1, wherein the digital transceiver comprises a wireless transceiver.

9. The LED assembly of claim 8, further comprising:

an antenna coupled to the wireless transceiver.

10. The LED assembly of claim of claim 9, wherein the antenna comprises an external antenna.

11. The LED assembly of claim of claim 9, wherein the antenna is arranged on the substrate.

12. The LED assembly of claim 9, wherein the antenna comprises a substrate antenna.

* * * * *